US007712418B2

(12) United States Patent
Brunn

(10) Patent No.: US 7,712,418 B2
(45) Date of Patent: May 11, 2010

(54) WATERPROOF CARTRIDGE SEAL

(75) Inventor: Michael Brunn, Sea Cliff, NY (US)

(73) Assignee: Combined Systems, Inc., Great Neck, NY (US)

( * ) Notice: Subject to any disclaimer, the term of this patent is extended or adjusted under 35 U.S.C. 154(b) by 0 days.

(21) Appl. No.: 12/315,764

(22) Filed: Dec. 5, 2008

(65) Prior Publication Data

US 2009/0090235 A1 Apr. 9, 2009

Related U.S. Application Data

(62) Division of application No. 11/117,128, filed on Apr. 28, 2005, now Pat. No. 7,461,597.

(60) Provisional application No. 60/566,530, filed on Apr. 28, 2004.

(51) Int. Cl.
*F42B 7/06* (2006.01)
*F42B 7/12* (2006.01)

(52) U.S. Cl. ..... 102/462; 102/452; 102/456; 102/466; 102/532; 86/18

(58) Field of Classification Search ..... 102/448, 102/449, 450, 451, 452, 453, 456, 457, 461, 102/462, 463, 464, 465, 466, 467, 532; 86/18, 86/1.1
See application file for complete search history.

(56) References Cited

U.S. PATENT DOCUMENTS 1,196,200 A 8/1916 Batcher
2,818,810 A 1/1958 Reynolds
3,352,239 A 11/1967 Schinnerer et al.
3,673,965 A 7/1972 Herter
3,974,770 A 8/1976 Clark, Jr.
4,164,903 A 8/1979 Bouza
4,452,144 A 6/1984 Maki
4,506,605 A 3/1985 Maki
4,574,701 A 3/1986 Fiocchi
4,587,905 A 5/1986 Maki
4,635,555 A 1/1987 Ferri
4,656,948 A 4/1987 Tsukiuda et al.
5,138,950 A 8/1992 Gardner et al.
5,361,701 A 11/1994 Stevens
5,408,931 A 4/1995 Tallman
5,710,391 A 1/1998 Chetcuti
5,861,572 A 1/1999 Schuermann
6,164,209 A 12/2000 Best et al.
6,202,562 B1 3/2001 Brunn et al.
6,250,228 B1 6/2001 King
6,260,484 B1 7/2001 Billings
6,305,291 B1 10/2001 Karlsson et al.
6,470,614 B1 10/2002 Johnson

*Primary Examiner*—James S Bergin
(74) *Attorney, Agent, or Firm*—Cohen Pontani Lieberman & Pavane LLP

(57) ABSTRACT

A closure wad is placed at the mouth of the launching end of a shotgun cartridge before the mouth is crimped down to seal the launching end of the cartridge. Both the walls of the closure cap and the walls at the mouth of the plastic envelope are crimped down together, thereby forming a substantially impermeable seal at the launching end of the cartridge. In addition, the inventive closure cap substantially reduces the detritus which is sometimes expelled when a launcher cartridge is fired.

6 Claims, 9 Drawing Sheets

FIG 2A
Roll Crimped Cartridge Shell with Rigid Wad 5 forming seal with inside surface of Cartridge Shell (PRIOR ART)
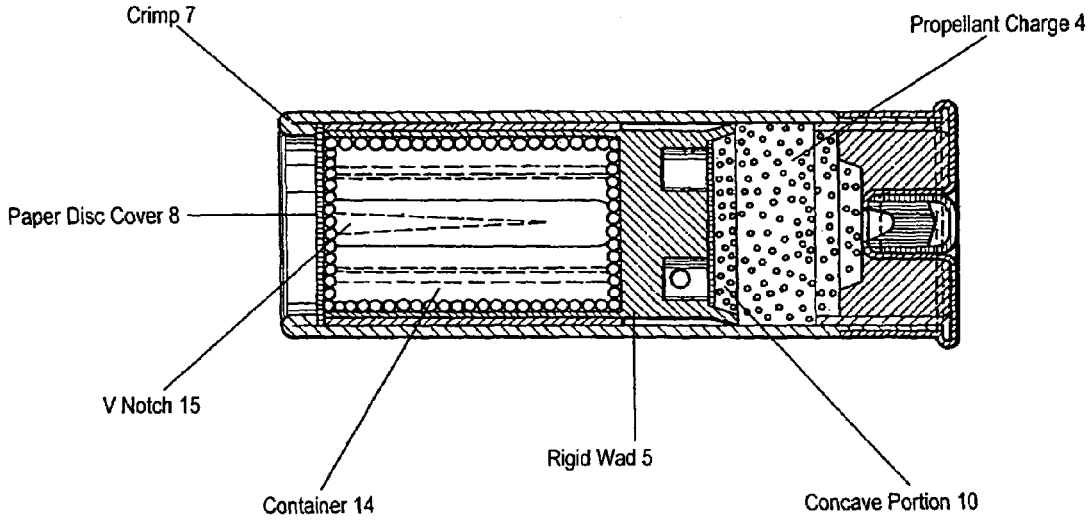
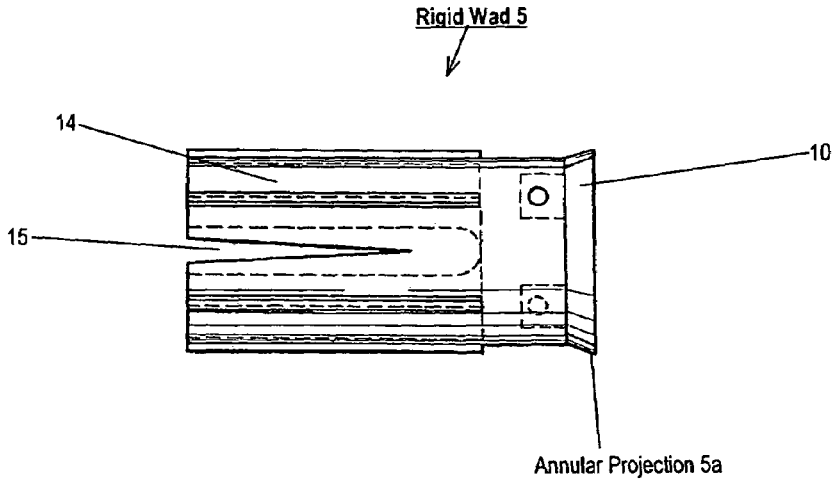
FIG 2B
Rigid Wad 5 from Cartridge Shell in FIG. 2A (PRIOR ART)

Cross-section of Closure Cap 470
Side Walls 474
Bottom 472

Plan view of Closure Cap 470
Scoring Pattern
Closure Cap 470

Components of
Waterproof Launcher Cartridge
Launcher Cartridge 400
Roll Crimp
474
472
Cardboard Tube 415
Plastic Envelope 420
Propellant Charge 430
Metal Base 410

WATERPROOF CARTRIDGE SEAL

CROSS-REFERENCE TO RELATED APPLICATIONS

This patent application is a Divisional of U.S. patent application Ser. No. 11/117,128, filed Apr. 28, 2005, now U.S. Pat. No. 7,461,597 which claims priority from U.S. Provisional Patent Application Ser. No. 60/566,530, filed Apr. 28, 2004, the disclosure content of which are hereby incorporated by reference in their entirety.

BACKGROUND OF THE INVENTION

1. Field of the Invention

The present invention relates generally to shotgun ammunition, and particularly to a system and method of sealing the launching end of a shotgun cartridge.

2. Description of the Related Art

The separate components comprising a conventional shotgun cartridge are shown FIG. 1A. Specifically, FIG. 1A shows the metal base 10 attached to the plastic envelope 20 which, when constructed, holds the propellant charge 30 tamped in the bottom of the cartridge next to metal base 10. In the center of metal base 10 is the primer which ignites the propellant charge 30 when struck by the hammer of the shotgun. The propellant charge 30 has a cushioning wad 40 also holding it in and separating the propellant charge 30 from the payload of this cartridge, which, in this case, is to be a less lethal projectile 50 comprised of a tubular sock-like body of fabric construction into which ballast material, such as lead shot, is filled, before the open end of the tubular sock-like body is tied off, as shown in FIG. 1A. The less lethal projectile 50 is held in the plastic envelope 20 of the cartridge by closure wad 60.

The launching end of the cartridge's plastic envelope 20 is typically sealed by either roll crimping or star crimping. FIG. 1B shows a sealed cartridge where roll crimping was used, i.e., the end walls of plastic envelope 20 have been rolled down in order to hold in closure wad 60 which can be seen at the launching end of the cartridge. FIG. 1C shows a sealed cartridge where star crimping was used, i.e., the end walls of plastic envelope 20 have been crimped, or bent, inwards in order to form a star-shaped seal at the launching end of the shotgun cartridge. When using a star crimp, it is possible to not use a closure wad 60, depending on the contents of the cartridge.

Plastic envelope 20 is typically made of high density polyethylene (HDP), although any appropriate material may be used, as is known to one skilled in the art. Propellant charge 30 is typically conventional black powder, although, once again, any appropriate propellant mixture may be used, as is known to one skilled in the art. In general, when any particular material is described in this application, it should be understood as an example, i.e., any material capable of performing the same function in the same manner is intended for use with the present invention. Similarly, when any particular method step is described in this application, it should be understood as exemplary, i.e., any manner of achieving the same function and/or result is intended to be covered by the present invention. Furthermore, it should be understood that a shotgun cartridge having a less lethal projectile as a payload is used as an example herein, and that the present invention may be applied to any type of cartridge, e.g., for a rifled or smoothbore barrel, with or without a payload, which requires sealing of its launching end.

In the conventional shotgun cartridge, cushioning wad 40 is typically constructed of plastic, while closure wad 60 is typically constructed of plastic or fiber (e.g., paper). It should be noted that the prior art contains a wide variety of "wad" constructions, from simple discs of paper to plastic cylindrical containers which also hold at least part of a payload to more complex structures which completely surround and contain the payload (see, e.g., the wad in FIG. 3 of U.S. Pat. No. 4,164,903 to Bouza et al., the wad 5 in FIGS. 1 and 2 of U.S. Pat. No. 4,506,605 to Maki, or the wad 22 in FIG. 1 of U.S. Pat. No. 6,260,484 to Billings, all of which are incorporated by reference in their entirety). Although only the roll and star crimps are shown in FIGS. 1B and 1C, respectively, any sort of crimping can be used to seal the launching end of the shotgun cartridge. Moreover, it is possible for a shotgun cartridge to have neither a closure wad per se nor a crimped launching end of the cartridge (see, e.g., the '903 patent cited above).

Further details concerning the exemplary prior art shotgun cartridge construction shown in FIGS. 1A-1B-1C can be found in U.S. Pat. No. 6,202,562 to Brunn et al. ("Method of Preparing a Low Lethality Projectile For Flight"), which is hereby incorporated by reference in its entirety. Some of the purposes, usage, and functioning of such a less lethal projectile may also be found therein. However, this description of an exemplary prior art less lethal projectile cartridge is not intended to limit the possible embodiments of the present invention described herein.

There is at least one problem with the typical crimping of the conventional shotgun cartridge: the seal formed by the crimping may allow material from the external environment into the interior cartridge. For example, if exposed to rain, water may leak directly into the cartridge through the small hole (shown in FIG. 1C) which is typically formed at the center of the star crimp. If there is no closure wad 60, there will be nothing to stop the water. Even if there is a closure wad 60, it may be made of paper or cardboard, which may become sodden, thereby allowing moisture into the interior of the cartridge (and perhaps also causing the closure wad to disintegrate). Even if the closure wad 60 is made of a water-impermeable material, such as HDP, the friction seal made by the closure wad 60 and the star crimped or roll crimped material of the plastic envelope 20 will not be tight enough to stop fluids such as water from seeping through at least some of the areas of surface contact between the closure wad 60 and the plastic envelope 20.

Furthermore, the typical material used for the plastic envelope 20 of the cartridge, HDP, is particularly difficult to adhere to, and, accordingly, glues, pastes, and other binding agents are not useful if one attempts to glue the closure wad 60 and the plastic envelope 20 together. This difficulty in adhesion also means that a tight friction seal between the closure wad 60 and the plastic envelope 20 requires a great deal of force to create, and, once created, it is likely that a fluid would still be able to seep in through at least one permeation in the seal between the closure wad 60 and the plastic envelope 20.

Although the HDP of the plastic envelope 20 can be heat soldered (this is the way the plastic envelope is attached to the metal base 10 of the cartridge before the primer or propellant charges are inserted), heat soldering the launching end of the plastic envelope 20 once the cartridge contents have been inserted presents an obvious hazard.

The prior art has largely ignored the problems with forming a tight seal at the launching end of the cartridge. In fact, when the prior art refers at all to forming a tight seal, the seal being referred to is between the plastic envelope 20 and the cushioning or obturating wad 40 between the propellant charge 30 and the payload 50. For example, U.S. Pat. No. 4,506,605 to Maki (the '605 patent) uses an annular projecting rim on a solid plastic obturating wad to form a seal between the wad and the inner surface of the cartridge. Specifically, as shown in FIGS. 2A and 2B (which are reproductions of FIGS. 1 and 2 in the '605 patent), the rigid wad 5 as shown alone in FIG. 2B comprises a cylindrical container 14 for shot (only shown lining the circumference of wad 5 in FIG. 2A) with V-shaped notches 15 as well as a base with a concave portion 10 which faces the propellant charge 4. The annular projection 5*a* of the base has a greater diameter than the remaining portions of wad 5. As shown in FIG. 2A, this annular projection 5*a* of the wad forms a seal with the inner surface of cartridge case in order "to prevent leakage of gases when the wad is located within the case 1 and which comes into contact with the inner surface 20 of the barrel 21 (FIG. 4) during the passage of the wad through the barrel" (col. 3, lines 3-8, the '605 patent).

In other words, the prior art wads that are directed to forming a tighter seal are directed to forming a tighter seal inside the cartridge to prevent the "leakage of gases" when the propellant charge ignites. These pieces of prior art barely mention the seal at the launching end of the cartridge: the '605 patent merely states that ". . . a quantity of pellets 6 is packed into the container 14 and are blocked with the paper disc cover 8 fitted to the opening end of the container 14 which is locked by crimp 7, or stopped by a so called starcrimp formed by folding the top end of the case inwardly" (col. 4, lines 46-51, the '605 patent). Thus, in the prior art, different wads forming different sorts of seals to keep in or otherwise manipulate the igniting propellant charge or flying payload are discussed, but the seal at the outer launching end of the cartridge is not described or discussed in any detail (see, e.g., U.S. Pat. No. 3,974,770 to Clark, Jr.; U.S. Pat. No. 4,574,701 to Fiocchi; U.S. Pat. No. 5,408,931 to Tallman; and U.S. Pat. No. 5,361,701 to Stevens, all of which are incorporated by reference in their entirety).

Although some of these prior art seals, such as the one formed by rigid wad 5 and the inner surface of the shotgun cartridge shown in FIG. 2A, may possibly protect the propellant charge from moisture which has entered the cartridge through the launching end of the cartridge, they provide no protection for the payload which is located above the obturating wad. In the case of shotgun launcher cartridges, which have a propellant charge but no payload (because such cartridges are used to "launch" a payload, such as a grenade, attached at the muzzle end of the shotgun barrel), the moisture coming in through the launching end of the cartridge could completely neutralize the propellant charge. Furthermore, the remnants of the closure wad of a shotgun launcher cartridge can be expelled when the launcher charge is ignited, possibly striking or landing on a nearby object or person.

Therefore, there is a need for a method and system for sealing the launching end of a cartridge, such as a shotgun shell, which effectively seals the contents therein from the external environment and, in the case of a shotgun launcher cartridge, prevents the ejection of the detritus left from the closure wad.

SUMMARY OF THE INVENTION

A system and method for sealing the launching end of a cartridge according to the present invention comprises a closure cap constructed of rigid material which is placed at the mouth of the launching end of the cartridge before the end of the plastic envelope is crimped down. Both the walls of the closure cap and the walls at the end of the plastic envelope are crimped down together, thereby forming a substantially impermeable seal at the launching end of the cartridge. Although roll crimping is shown below in the description of the presently preferred embodiments, any kind of crimping, either now existing or to be developed in the future, may be used to crimp down the walls of the closure cap and the launching end of the cartridge according to the present invention.

The closure cap is cylindrical in shape with a solid bottom end and an open top end, where the open top end is substantially 'lined up' with the launching end of the cartridge before crimping. Thus, during crimping, both the walls of the plastic envelope and the walls of the closure cap are crimped tightly together, as will be described and shown in more detail below. The depth of the closure cap (i.e., the 'height' of the cylindrical shape) can be varied depending on the payload (or lack thereof) and purpose of the cartridge.

The inventive system and method has been tested, and the tests have proved that a shotgun cartridge constructed according to the system and method will keep the interior of a shotgun cartridge dry, even when the cartridge is completely submerged in water.

In a presently preferred embodiment of the present invention, the bottom end of the closure cap is weakened by scoring the rigid material of which it is comprised. In one implementation, the scoring pattern of a closure cap used in a less-lethal projectile shotgun cartridge is pie-shaped, so that the pie "pieces" petal outwards when the less-lethal projectile is ejected by the force of the igniting propellant. In another implementation, the pie-shaped scoring pattern is somewhat modified, resulting in the disintegration of the center portion when the propellant discharges. Although a pie-shaped pattern is used in both of those implementations, any scoring pattern may be used in accordance with the present invention. Furthermore, a substantially impermeable seal at the launching end of a cartridge according to the present invention may be implemented without any scoring pattern at all.

In another presently preferred embodiment of the present invention, different scoring patterns are used as a tactile means for identifying the type of cartridge, e.g., a pie-shaped pattern could indicate a less-lethal projectile cartridge, whereas a series of concentric rings could indicate launching cartridge. Such a system would be helpful in environments where there is little light, so that a user may identify the type of cartridge he or she is holding by running his or her finger over the scoring on the closure cap at the launching end of the cartridge. Even in well lit environments, such a tactile identification system would serve as an additional safeguard to ensure that the user is handling the appropriate type of cartridge. This embodiment would require roll crimping, or, at the least, a form of crimping which would leave the scoring pattern exposed.

In yet another presently preferred embodiment of the invention, the color of the closure caps are used as a visual means for identifying the type of cartridge, e.g., an orange closure cap could indicate a low-lethal projectile cartridge, while a green closure cap could indicate a launching cartridge. In a preferred implementation of such a system according to the presently preferred embodiment, the plastic envelope of the cartridge is at least partially translucent so that the color of the closure cap may be seen by looking through the sides of the cartridge as well by looking directly into the launching end of the cartridge.

Other objects and features of the present invention will become apparent from the following detailed description considered in conjunction with the accompanying drawings; whereas the various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings:

FIG. 2A is a schematic diagram of a cross-section of a shotgun cartridge according to the prior art;

FIG. 2B is a schematic diagram of a cross-section of the wad within the prior art shotgun cartridge of FIG. 2A;

DETAILED DESCRIPTION OF THE PRESENTLY PREFERRED EMBODIMENTS

In this Detailed Description, a number of embodiments will be discussed, and two particular preferred embodiments will be shown and described in detail with reference to the drawings. Specifically, FIGS. 3A-3F show a presently preferred embodiment of the invention implemented as a less lethal projectile shotgun cartridge similar to the prior art less lethal projectile shotgun cartridge of FIGS. 1A-1C; FIGS. 4A-4E show another presently preferred embodiment of the invention implemented as a launcher shotgun cartridge; and FIG. 5 shows the results of crimping according to the present invention in greater detail. As stated above, although a shotgun cartridge having a less lethal projectile as a payload and a launcher cartridge are used as examples herein, the present invention may be applied to any type of cartridge which requires sealing of its launching end, regardless of payload, if any, or whether such a cartridge is for a rifled or smooth-bore barrel.

Figure 1A:
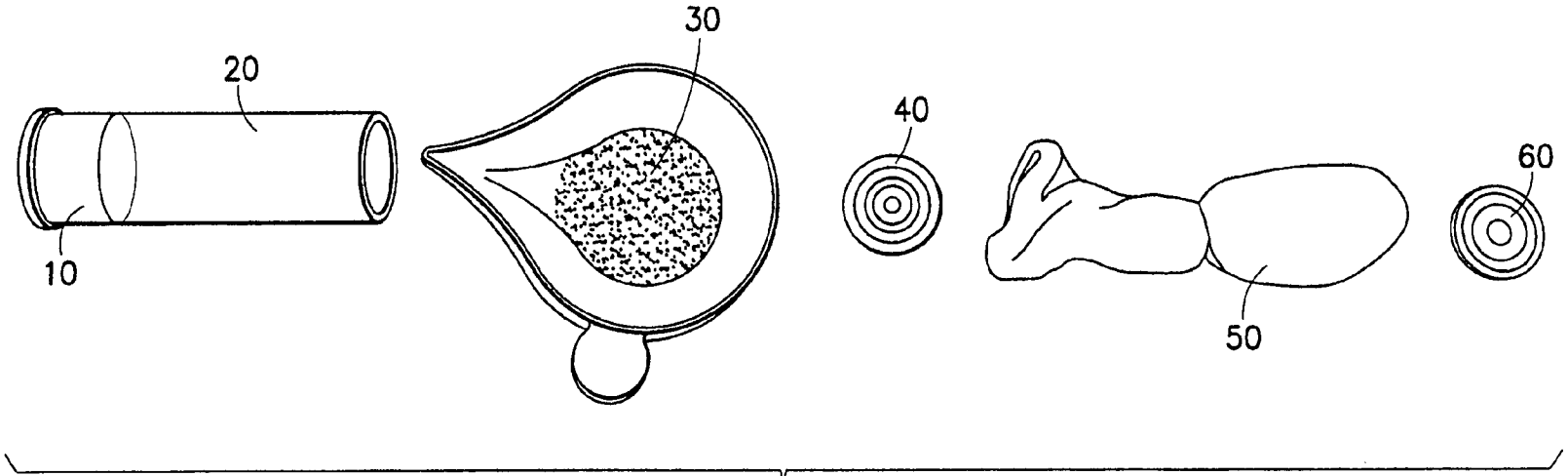
FIG. 1A PRIOR ART
FIG. 1A shows the separate components of an exemplary prior art shotgun cartridge.
Figure 1C:
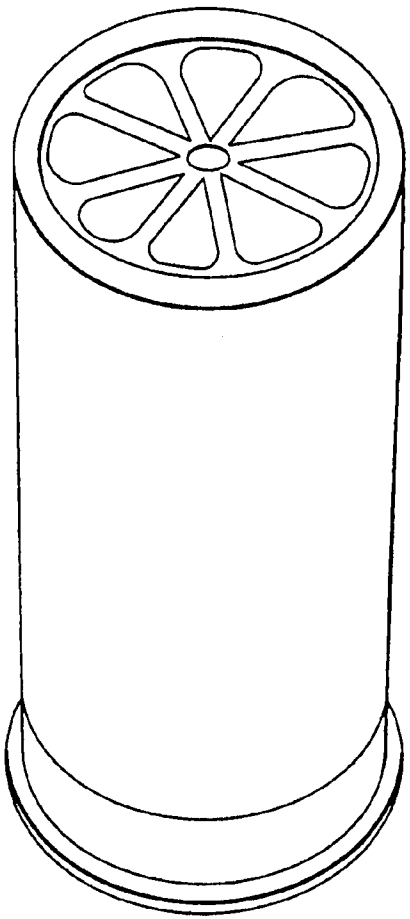
FIG. 1C PRIOR ART
FIG. 1C shows a sealed shotgun cartridge of the prior art, where a star crimp is used to seal the launching end of the cartridge.
Figure 3A:
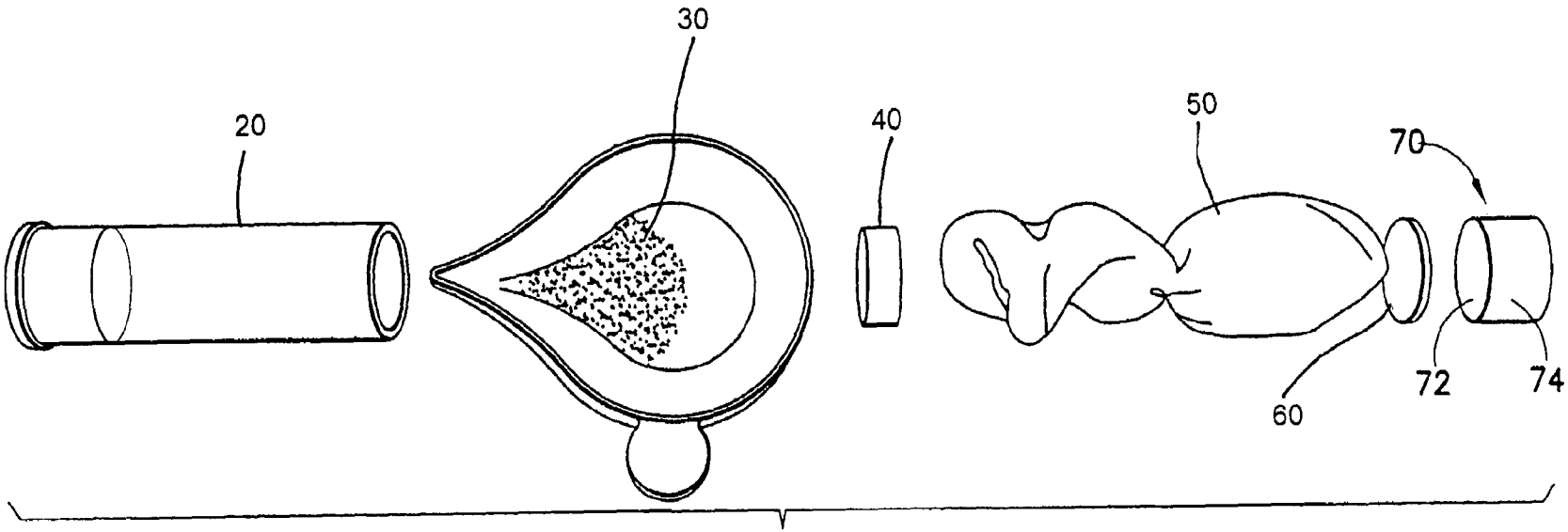
FIG. 3A shows the separate components of an exemplary shotgun cartridge according to a presently preferred embodiment of the present invention.

FIG. 3A shows the separate components comprising a presently preferred embodiment implemented as a less lethal projectile shotgun cartridge, similar to the prior art example in FIG. 1A. Specifically, FIG. 3A shows the same metal base 10 and attached plastic envelope 20, as well as the propellant charge 30 which will be tamped into the bottom of the cartridge. The propellant charge 30 also has the same cushioning wad 40 holding it in and separating the propellant charge 30 from the less lethal tubular sock-like fabric projectile 50. The closure wad 60 is also similarly situated.

However, closure wad 60 is no longer the final, or 'top', component in the plastic envelope 20. In the presently preferred embodiment, closure cap 70 is located atop closure wad 60. As can be seen in FIG. 3A, closure cap 70 is cylindrically shaped, i.e., it has cylindrical circumferential walls 74 having a diameter corresponding to the diameter of the inner surface of plastic envelope 20. At one end of closure cap 70 is a solid bottom 72 which faces the interior of the plastic envelope, whereas the other end of closure cap 70 is open, as will be seen in FIGS. 3B-3C-3D. Preferably, closure cap 70 is comprised of HDP (however, any material capable of performing the functions of the closure cap described herein may be used in accordance with the present invention).

Figure 3B:
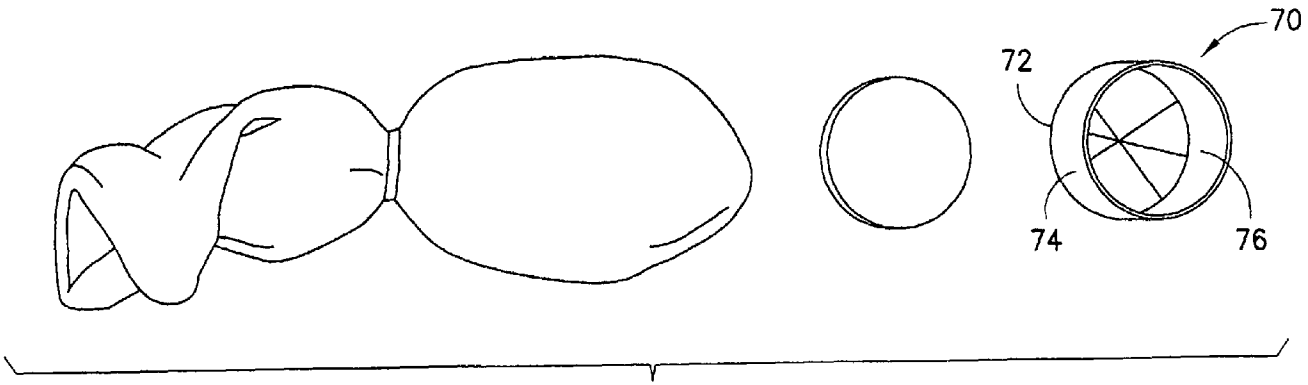
FIG. 3B shows the closure cap 70, closure wad 60, and less-lethal projectile 50 of FIG. 3A in greater detail, according to the presently preferred embodiment of the present invention.

FIG. 3B is a close up of the payload 50, closure wad 60, and closure cap 70 shown in FIG. 3A. In FIG. 3B, closure wad 60 and closure cap 70 are laid flat, rather than lying on their sides as they are in FIG. 3B. Thus, the open mouthed end 76 of closure cap 70 can be seen facing the viewer. In addition, pie slice-shaped scoring can be seen on the top surface (i.e., the surface facing the outside of the cartridge) of the bottom 72 of closure cap 70. The bottom 72 of closure cap 70 is thereby weakened along the lines scored into its surface. When propellant charge 30 is ignited, forcing payload 50 forward, the bottom end 72 of closure cap 70 will break along the scored lines, and petal out from the center of bottom 72, as will be discussed further below in reference to FIG. 3E-3F.

Figure 1B:
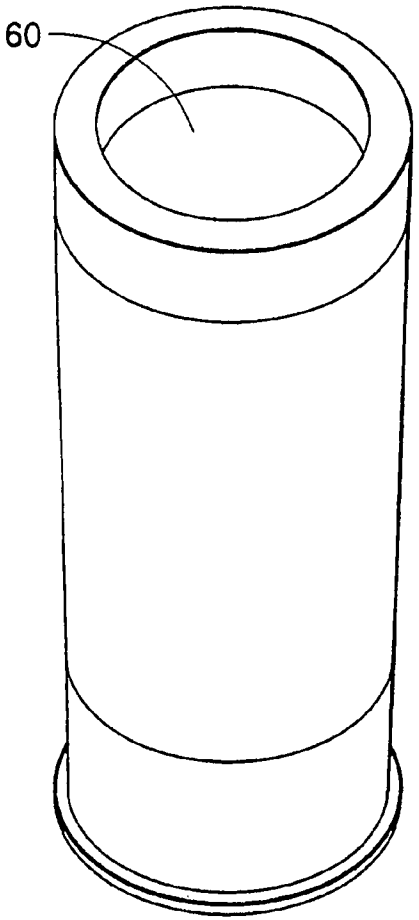
FIG. 1B PRIOR ART
FIG. 1B shows a sealed shotgun cartridge of the prior art, where a roll crimp is used to seal the launching end of the cartridge.
Figure 3C:
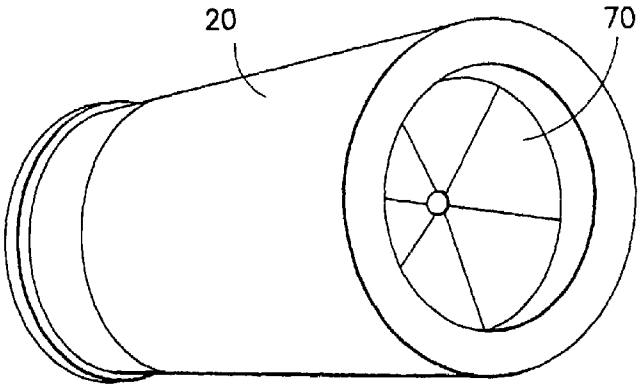
FIG. 3C shows the components of FIG. 3A assembled as a shotgun cartridge, but not yet sealed, according to the presently preferred embodiment of the present invention.

FIG. 3C shows the components of FIG. 3A assembled as a shotgun cartridge, similarly to FIG. 1B, but not yet crimped/sealed. The top edges forming the open end 76 of closure cap 70 are substantially aligned with the top edges which form the open mouth at the launching end of the plastic envelope.

When crimping is performed, both the top portion of plastic envelope 20 and the top portion of the cylindrical walls 74 of closure cap 70 will be folded, or rolled, together, thereby creating a substantially impermeable mechanical seal at the launching end of the cartridge. The result of roll crimping the assembled cartridge of FIG. 3C is shown in FIG. 3D, where the scoring on the bottom end 72 of closure cap 70 can be clearly seen.

Figure 3D:
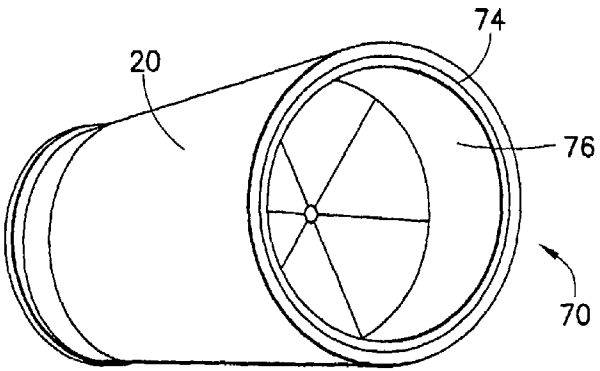
FIG. 3D shows the assembled shotgun cartridge of FIG. 3C sealed with a roll crimp, according to the presently preferred embodiment of the present invention.

The height of the side walls 74 of the closure cap 70 shown in FIGS. 3A-3B-3C-3D is such that the bottom end 72 of closure cap 70 is not far below where the roll crimp stops in FIG. 3D, thus allowing the maximum amount of space within the sealed cartridge for the payload 50. When using most forms of crimping, such as roll crimping, the uncrimped height of the side walls 74 of closure cap 70 (e.g., FIG. 3C) must be at least double the crimped height of the side walls 74 (e.g., FIG. 3D) or else the crimping will continue past the side walls 74 and into the bottom end 72 of the closure wad 70, thereby causing the bottom end 72 to either deform or more likely break.

The side walls 74 of other embodiments according to the present invention may have an uncrimped height which is greater than roughly double the width of the closure cap once it is crimped. Furthermore, it is contemplated that the closure cap according to an embodiment of the present invention could be constructed such that it will be deliberately deformed, and thereby weakened, during the crimping process. Further still, any crimping process, either existing now or in the future, can be used in accordance with the present invention, which may or may not require variations in the construction of closure cap 70. In short, the overall construction, including the width, of a closure cap according to the present invention can be varied depending on one or more of the following: the crimping process used, the type and size of payload (or lack thereof, the intended use and/or purpose of the cartridge, the storage environment of the cartridge, and any other factor which may or may not cause a variation in the closure cap construction.

FIG. 5 shows a magnified view of the launching end of a cartridge 500 assembled and sealed according to a presently preferred embodiment of the present invention, where a portion 505 of cartridge 500 has been sliced off the launching end of cartridge 500, thereby showing the results of roll crimping the walls 574 of closure cap 570 and the walls at the launching end of cartridge 500 together. The compression caused by crimping both the walls of the cartridge and the walls of the closure cap together is sufficient to create a seal which is substantially impermeable to the external environment in general, and fluid and moisture in particular. Although crimping alone has been shown to provide a sufficiently impermeable seal, it is also contemplated that other means of sealing could also be used in tandem with crimping. For example, ultrasound welding could be used to perfect the seal before or after crimping.

Figure 3E:
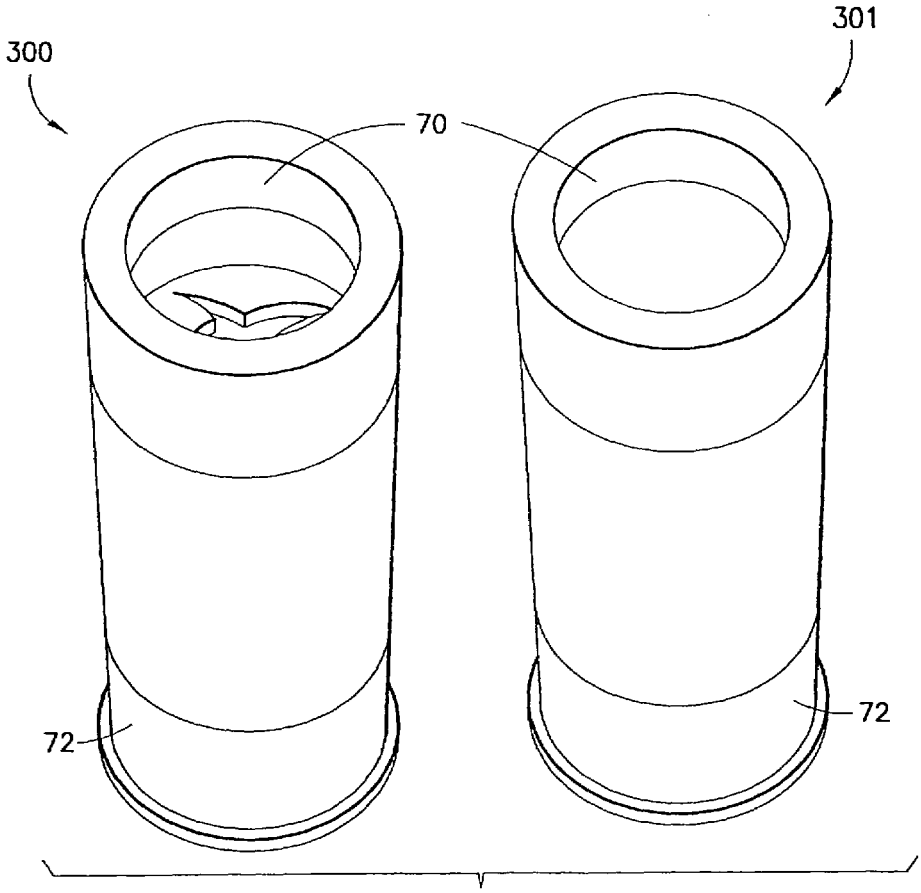
FIG. 3E shows a side perspective view of two assembled shotgun cartridges, one of which has been discharged, the other of which has not been discharged, according to the presently preferred embodiment of the present invention.
Figure 3F:
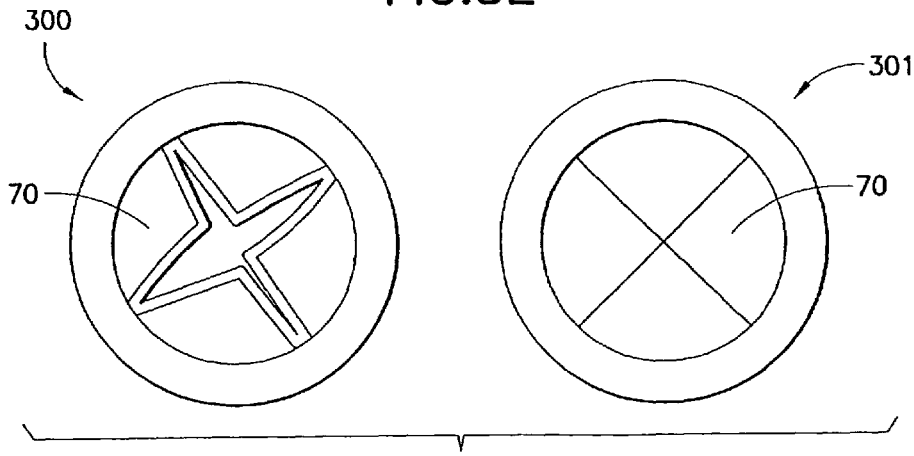
FIG. 3F shows a top view of the two assembled shotgun cartridges in FIG. 3E, according to the presently preferred embodiment of the present invention.

As discussed in reference to FIG. 3B above, the bottom 72 of closure cap 70 has pie-shaped scoring so that, when the propellant is ignited, forcing payload 50 forward, the bottom end 72 of closure cap 70 will break along the scored lines, and petal out from the center of bottom 72. FIGS. 3E-3F show two different views of two assembled shotgun cartridges, similar to the assembled shotgun cartridge shown in FIG. 3D; however, cartridge 300 shows how the portions of bottom 72 of the closure cap 70 petal outward during discharge of the cartridge, whereas cartridge shows bottom 72 before discharge of the cartridge. As can be seen, because the scored portions of the rigid material forming bottom 72 of closure cap 70 are weakened in comparison to the unscored portions of bottom 72, the scored portions break first, resulting in the remaining unscored pie-slice-shaped portions petaling outwards.

In the presently preferred embodiments described in reference to FIGS. 3A-3F and FIGS. 4A-4E, the bottom 472 of the closure cap 470 is coined during the plastic molding process when the closure cap is formed. As mentioned above, scoring is not necessary to practice the present invention but provides certain benefits, as described herein or would be known and/or discovered by one skilled in the art. For example, in one of the two further preferred embodiments discussed below, scoring is used to help identify the type of payload and/or cartridge.

FIGS. 4A-4E show another presently preferred embodiment of the present invention implemented as a launcher shotgun cartridge. A launcher shotgun cartridge is a blank cartridge which is used to propel a payload held at the muzzle end of the shotgun by a launching cup or bell. Because its only purpose is to provide the motive force to hurl the payload held by the launching cup, the launcher cartridge contains no payload. Prior art launcher cartridges have at least two problems caused by their construction: one is the potential leakage of moisture through either the launching end or the ignition end of the cartridge, and the other is the detritus that is hurled out of the muzzle end of the shotgun behind the payload. The moisture can substantially degrade or completely neutralize the propellant charge contained in the cartridge. The detritus, usually consisting of the wad at the launching end of the cartridge which holds in the propellant charge, can possibly strike or land on a nearby object or person.

Figures 4A, 4B, 4C:
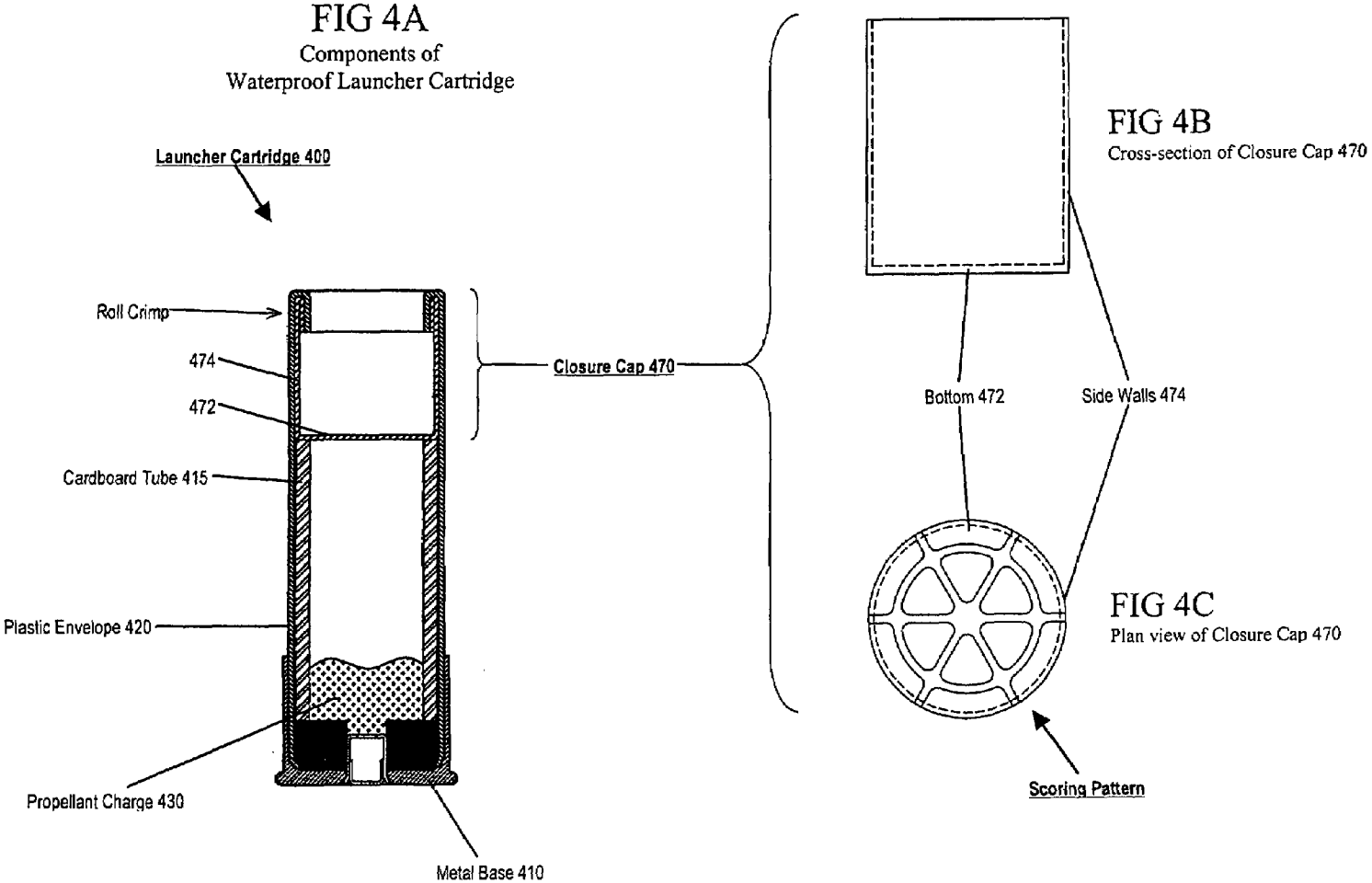
FIG. 4A is a schematic diagram of a cross-section of a shotgun launcher cartridge according to another presently preferred embodiment of the present invention.
FIG. 4B is a schematic diagram of a cross-section of the closure cap within the shotgun cartridge of FIG. 4A according to the other presently preferred embodiment of the present invention.
FIG. 4C is a schematic diagram showing the scoring on the bottom surface of the closure cap within the shotgun cartridge of FIG. 4A according to the other presently preferred embodiment of the present invention.

The other presently preferred embodiment of the present invention implemented as a launcher shotgun cartridge, as shown in FIGS. 4A-4E, substantially solves both of these prior art launcher cartridge problems. FIG. 4A is a schematic diagram of a cross-section of a launcher shotgun cartridge 400 according to the other presently preferred embodiment of the present invention. In the launcher cartridge of FIG. 4A, plastic envelope 420 is attached to metal base 410 in a manner similar to the embodiment of FIGS. 3A-3F and prior art cartridges. Cardboard tube 415 fits within a substantial portion of plastic envelope 420 and contains the black powder propellant charge 430. Although tube 415 is cardboard in this embodiment, it can be constructed of any suitable material.

Closure cap 470 holds cardboard tube 415 in place within plastic envelope 420. As can be seen in FIG. 4A, the launching end of the cartridge has been roll crimped, thereby sealing the closure cap 470 in place. Because the seal formed by roll crimping the plastic envelope 420 and the closure cap 470 together is substantially impermeable, fluid will not be able to flow into the launcher cartridge 400 through the launching end. The metal base 410 of launcher cartridge 400 is covered with a moisture proof varnish to insure that no fluid will enter through the separate portions comprising metal base 410. Thus, the contents held within the launcher cartridge, including the propellant charge 430 and the cardboard tube 415, will stay dry when the launcher cartridge 400 is in a moist environment or even when launcher cartridge 400 is completely submerged in water. Although the metal base 410 is treated with moisture proof varnish in this embodiment, a launcher cartridge according to other embodiments of the present invention may be implemented without a moisture proof varnish treatment on the metal base.

FIG. 4B is a schematic diagram of a cross-section of the closure cap 470 which is held within launcher cartridge 400 of FIG. 4A. As can be seen in FIG. 4B, the width of material forming the side walls 474 and bottom 472 are roughly uniform; however, side walls 474 are less thick than bottom 472, and the scoring (or coining) in the bottom 472 of closure cap 470 makes its thickness non-uniform. FIG. 4C is a schematic diagram showing the scoring pattern in the bottom 472 of closure cap 474. In the presently preferred embodiment, the scoring pattern is made by coining the inside surface of closure cap 470, leaving roughly a thickness of 0.005" in the coined area. Further details concerning the measurements of the launcher cartridge according to the other presently preferred embodiment may be found in the technical schematics filed in U.S. Provisional Patent Application Ser. No. 60/566,530, from which the present application claims priority and which is incorporated by reference in its entirety.

The launcher cartridge, and more specifically, the closure cap construction of the launcher cartridge, according to the other presently preferred embodiment substantially diminishes the problems found in prior art launcher cartridges. First, the substantially impermeable seal formed by the roll crimped closure cap (and, optionally, the metal base treated with moisture proof varnish) provides substantial protection against moisture leaking into the inside of the launcher cartridge. Second, the closure cap construction results in the launcher cartridge remaining substantially intact after discharge, as shown in FIGS. 4D-4E.

Figure 4D:
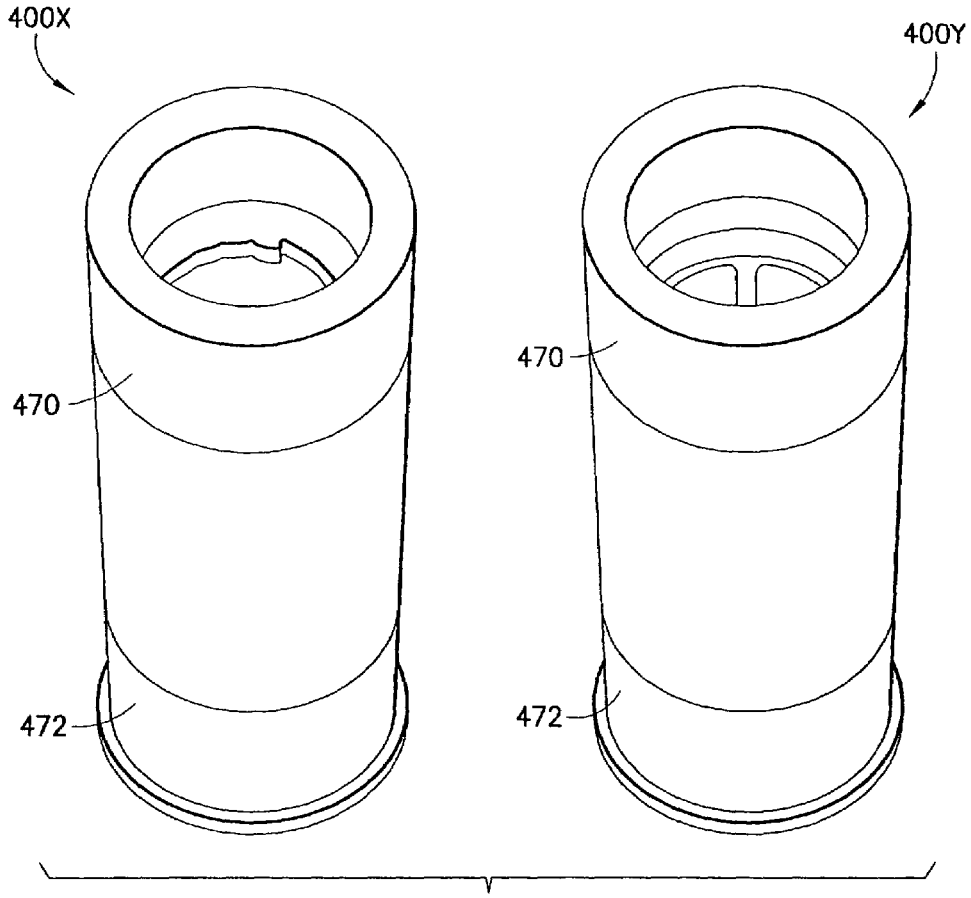
FIG. 4D shows a side perspective view of two assembled shotgun cartridges, one of which has been discharged, the other of which has not been discharged, according to the other presently preferred embodiment of the present invention.
Figure 4E:
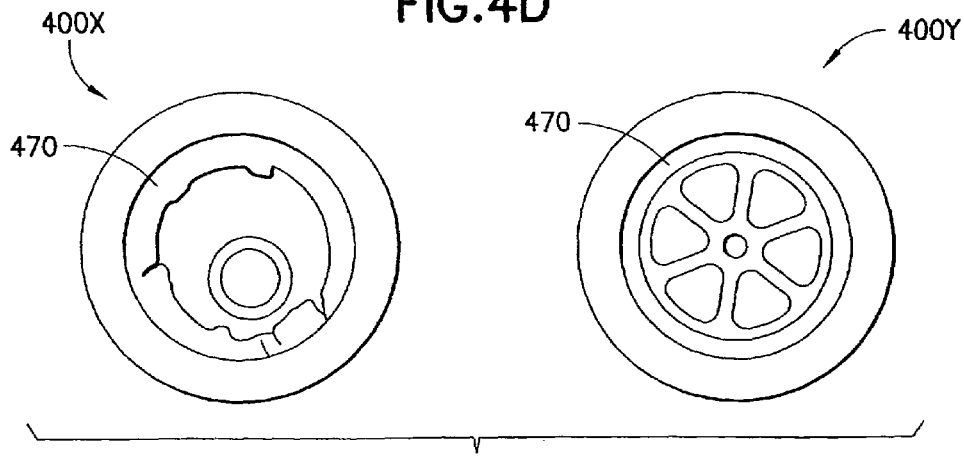
FIG. 4E shows a top view of the two assembled shotgun cartridges in FIG. 4D, according to the other presently preferred embodiment of the present invention.
Figure 5:
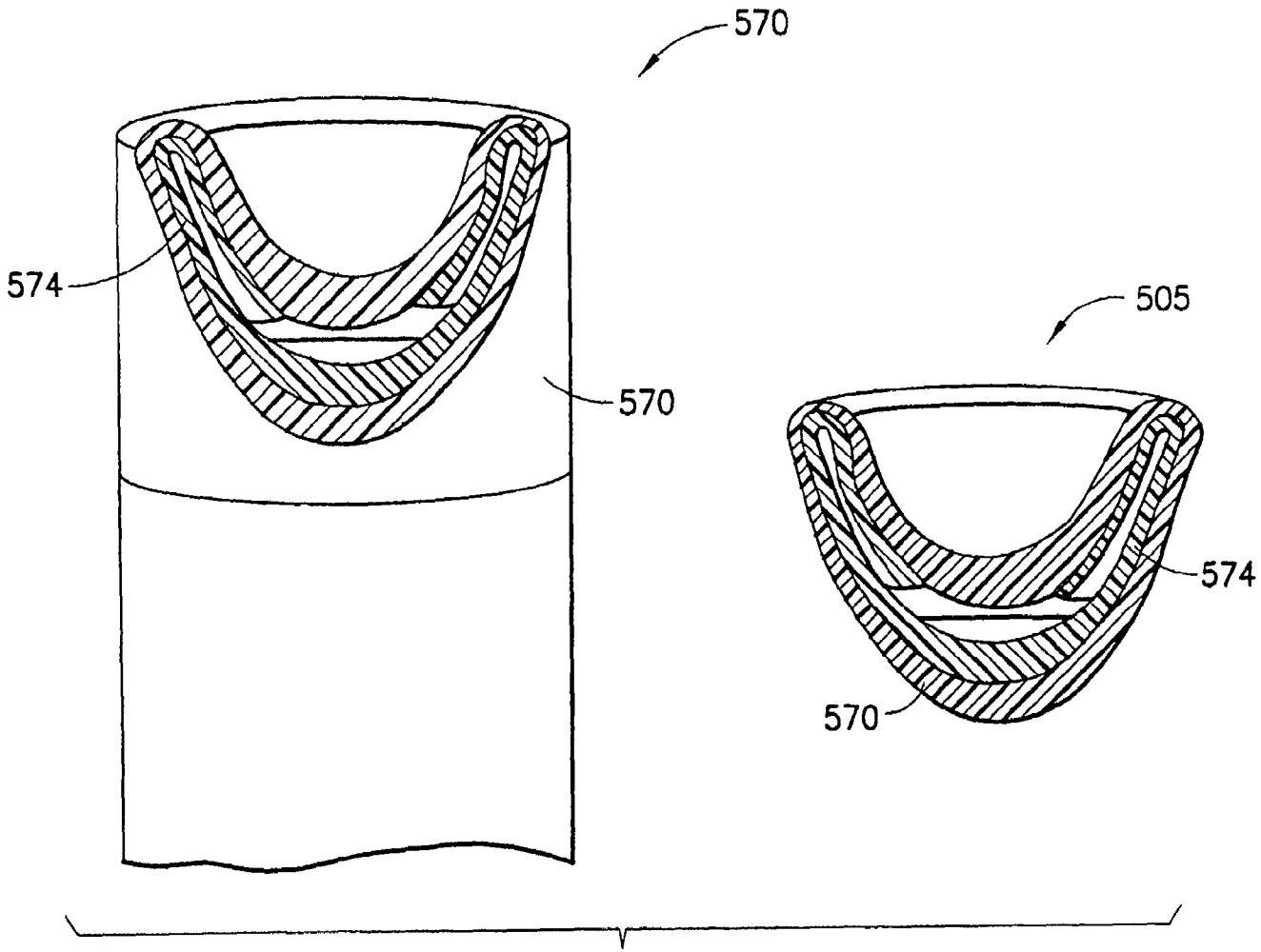
FIG. 5 shows a magnified view of the launching end of a cartridge constructed according to a presently preferred embodiment of the present invention, where a portion of the cartridge has been sliced off in order to show the roll crimping.

FIGS. 4D-4E show two different views of two launcher cartridges assembled according to the presently preferred embodiment of FIGS. 4A-4C. Launcher cartridge 400X in FIGS. 4D-4E has been discharged, while launcher cartridge 400Y has not been discharged. Cartridge 400X shows that, when the scored portions in the bottom 472 of closure cap 470 break during discharge of the cartridge, the center portion of bottom 472 substantially disintegrates and is discharged from the muzzle of the shotgun with the force of the propellant ignition. However, the bits of rigid material which are discharged are so small as to not pose a substantial hazard to the animate or inanimate objects in the immediate environment of the shotgun. On the other hand, the more substantial portions of the launcher cartridge, such as cardboard tube 415 and most of the material forming closure cap 470, remain intact within the launcher cartridge after discharge. In testing the launcher cartridge constructed according to the presently preferred embodiment shown in FIGS. 4A-4C, it has been found that these portions remain intact within the launcher cartridge during discharge roughly 99% of the time.

Furthermore, cartridges constructed according to the inventive system and method have been tested to determine whether a shotgun cartridge constructed according to the system and method can keep the interior of the shotgun cartridge dry, even when the cartridge is completely submerged in water. There was no change in weight of any of the submerged cartridges, i.e., there was no leakage of moisture into any of the cartridges, even when the cartridges were completely submerged.

It is contemplated that, in other embodiments of the present invention, different scoring patterns may be used as a tactile means for identifying the type of cartridge, e.g., a pie-shaped pattern could indicate a low-lethal projectile cartridge, whereas a series of concentric rings could indicate a launching cartridge. Such a system would be helpful in environments where there is little light, so that a user may identify the type of cartridge he or she is holding by running his or her finger over the scoring on the closure cap at the launching end of the cartridge. Even in well lit environments, such a tactile identification system would serve as an additional safeguard to ensure that the user is handling the appropriate type of cartridge. This embodiment would require roll crimping, or, at the least, a form of crimping which would leave the scoring pattern exposed, i.e., capable of being touched.

It is further contemplated that, in yet other embodiments of the present invention, the color of the closure caps may be used as a visual means for identifying the type of cartridge, e.g., an orange closure cap could indicate a low-lethal projectile cartridge, while a green closure cap could indicate a launching cartridge. In a preferred implementation of such a system, the plastic envelope of the cartridge is at least partially translucent so that the color of the closure cap may be seen by looking through the sides of the cartridge as well by looking directly into the launching end of the cartridge. In this context, "at least partially translucent" can mean either, or both, that (i) only a top portion of the plastic envelope is translucent, thereby allowing the color of at least a portion of the closure cap to be seen when viewing the cartridge from the side, and/or that (ii) the translucence of the material forming the plastic envelope ranges from substantially clear to substantially semi-opaque (but still translucent enough for a viewer to determine the color of the closure cap). Of course, in other embodiments, the plastic envelope may be completely opaque, in which case the identifying color can only be viewed by looking directly at the uncovered portion of the closure cap at the launching end of the cartridge. The scoring can be used for visual identification as well.

In conclusion, the system and method according to the present invention provides a substantially impermeable seal at the launching end of a cartridge and reduces the amount of detritus expelled from an ignited launcher cartridge. According to the two presently preferred embodiments of the present invention shown herein, a closure cap having a scored surface on the bottom end is roll crimped in place at the launching end of the cartridge. According to contemplated embodiments of the present invention, at least one of different scoring patterns on the bottom end of the closure cap and different colors of the closure cap may be used as a form of identification for the type, payload, purpose, and/or some other characteristic of the cartridge.

While there have shown and described and pointed out fundamental novel features of the invention as applied to presently preferred embodiments thereof, it will be understood that various omissions and substitutions and changes in the form and details of the substances, constructions, and orientations illustrated and described, and in their operation, may be made by those skilled in the art without departing from the spirit of the invention.

For example, although only the roll and star crimps are shown in the present disclosure, any sort of crimping can be used to seal the launching end of the shotgun cartridge in accordance with the present invention. As another example, it should be understood that cartridges and/or closure wads according to the present invention may be implemented in a wide variety of ways, having different dimensions and/or different scoring patterns (or lack thereof) than the presently preferred embodiments described herein. For instance, there may be scoring on the other side of the bottom of the closure cap (or on both sides). As another instance, the cartridge may be for a much larger or much smaller barrel than a conventional shotgun, thereby changing the dimensions of the closure wad, as well as, possibly, its substance.

Furthermore, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method of manufacturing a cartridge, said cartridge comprising a rigid base, an envelope having an opening at a launching end, a closure wad at the launching end of the envelope, and a closure cap disposed adjacent said closure wad, said closure cap having a side wall, a bottom and an opening, said side wall extending from said bottom, said bottom and said side wall forming a tube having said bottom at one end and said opening of the closure cap at the other end opposite said bottom, the method comprising the steps of: placing the closure cap at a launching end of the envelope such that (i) the side wall of the closure cap is inside and touching the wall of the launching end of the envelope, (ii) the opening of the closure cap and the opening of the envelope are parallel, and (iii) the bottom of the closure cap is more interior within the envelope than the opening of the closure cap; and simultaneously crimping the side wall of the closure cap and the wall of the launching end of the envelope such that a substantially impermeable seal is formed at the launching end of the envelope of the cartridge.

2. The method of claim 1, wherein the cartridge is a shotgun cartridge.

3. The method of claim 1, wherein the closure cap has an indicia indicating a characteristic of the cartridge.

4. The method of claim 3, wherein the characteristic indicated by the indicia comprises a type of payload in the cartridge.

5. The method of claim 3, wherein the indicia comprises at least one of a color of the closure cap and a scoring pattern in the bottom of the closure cap.

6. The method of claim 1, further comprising the step of: creating a scoring pattern on the bottom of the closure cap.

* * * * *